US005705130A

United States Patent [19]

Hedrick

[11] Patent Number: 5,705,130

[45] Date of Patent: Jan. 6, 1998

[54] FCC FEED INJECTION WITH NON-QUIESCENT MIXING

[75] Inventor: Brian W. Hedrick, Rolling Meadows, Ill.

[73] Assignee: UOP, Des Plaines, Ill.

[21] Appl. No.: 725,100

[22] Filed: Oct. 2, 1996

Related U.S. Application Data

[60] Division of Ser. No. 323,468, Oct. 14, 1994, Pat. No. 5,562,818, which is a continuation-in-part of Ser. No. 92,635, Jul. 16, 1993, Pat. No. 5,358,632.

[51] Int. Cl.[6] ..... F27B 15/08

[52] U.S. Cl. ..... 422/145; 422/143; 208/163

[58] Field of Search ..... 422/143, 144, 422/145; 208/163, 113, 120, 127, 153, 164

[56] References Cited

U.S. PATENT DOCUMENTS

| | | | |
|---|---|---|---|
| 3,071,540 | 1/1963 | McMahon et al. | 208/163 |
| 3,261,776 | 7/1966 | Baumann et al. | 708/113 |
| 4,427,538 | 1/1984 | Bartholic | 208/127 |
| 4,427,539 | 1/1984 | Busch et al. | 208/127 |
| 4,427,937 | 1/1984 | Dean et al. | 708/120 |
| 4,434,049 | 2/1984 | Dean et al. | 208/153 |
| 4,479,870 | 10/1984 | Hammershaimb et al. | 208/164 |
| 4,578,183 | 3/1986 | Chou et al. | 422/143 |
| 4,681,743 | 7/1987 | Skraba | 422/145 |
| 4,717,467 | 1/1988 | Haddad et al. | 208/113 |
| 5,139,748 | 8/1992 | Lomas et al. | 422/140 |
| 5,205,992 | 4/1993 | van Ommen et al. | 422/143 |
| 5,554,351 | 9/1996 | Wells et al. | 422/145 |

*Primary Examiner*—Timothy McMahon
*Attorney, Agent, or Firm*—Thomas K. McBride; John G. Tolomei

[57] ABSTRACT

An FCC feed distributor mixes fresh catalyst entering the riser with steam to create a dense bubbling bed of catalyst. Fluidized catalyst rises from the dense bed around a conical section supported from the bottom of the riser. The conical section accelerates the catalyst by reducing the flow area into a small width annulus. As fast fluidized catalyst flows to the annulus, a diverter outwardly redirects an axially flowing feed stream to discharge feed radially into the catalyst as it flows by the annular section. A narrow width of the annular section provides good penetration of the catalyst stream by the feed to quickly and completely mix the catalyst and feed. A tapered conical section above the narrow annular section provides an extended region of gradually increasing flow area that controls downstream acceleration of the gas and catalyst mixture by permitting expansion and preventing back mixing over the initial stages of the cracking reaction. This arrangement improves the uniformity of gas and catalyst contacting while reducing the amount of steam or other dispersion gas required to achieve good catalyst and feed contact.

4 Claims, 2 Drawing Sheets

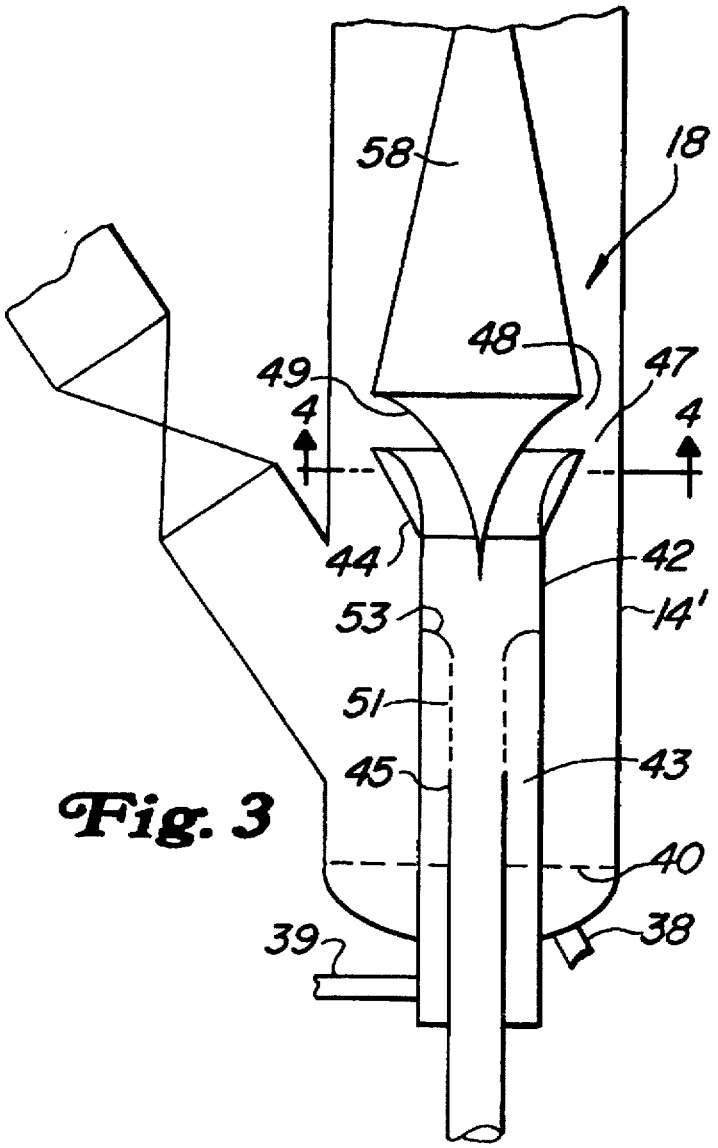
Fig. 3
Fig. 4
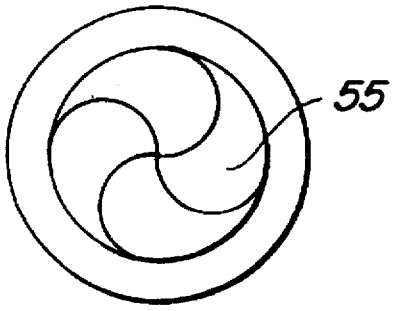

FCC FEED INJECTION WITH NON-QUIESCENT MIXING

CROSS REFERENCE TO RELATED APPLICATIONS

This application is a divisional application of prior application Ser. No. 08/323,468 filed Oct. 14, 1994, now issued as U.S. Pat. No. 5,562,818, which is a continuation in part of U.S. Ser. No. 08/092,635 that was filed on Jul. 16, 1993, now U.S. Pat. No. 5,358,632 the contents of which are hereby incorporated by reference.

BACKGROUND OF THE INVENTION

1. Field of the Invention

This invention relates generally to the dispersing of liquids into fluidized solids. More specifically this invention relates to a method and apparatus for dispersing a hydrocarbon feed into a stream of fluidized catalyst particles.

2. Description of the Prior Art

There are a number of continuous cyclical processes employing fluidized solid techniques in which carbonaceous materials are deposited on the solids in the reaction zone and the solids are conveyed during the course of the cycle to another zone where carbon deposits are at least partially removed by combustion in an oxygen-containing medium. The solids from the latter zone are subsequently withdrawn and reintroduced in whole or in part to the reaction zone.

One of the more important processes of this nature is the fluid catalytic cracking (FCC) process for the conversion of relatively high-boiling hydrocarbons to lighter hydrocarbons boiling in the heating oil or gasoline (or lighter) range. The hydrocarbon feed is contacted in one or more reaction zones with the particulate cracking catalyst maintained in a fluidized state under conditions suitable for the conversion of hydrocarbons.

It has been found that the method of contacting the feedstock with the catalyst can dramatically affect the performance of the reaction zone. Modem FCC units use a pipe reactor in the form of a large, usually vertical, riser in which a gaseous medium upwardly transports the catalyst in a fluidized state. Ideally the feed as it enters the riser is instantaneously dispersed throughout a stream of catalyst that is moving up the riser. A complete and instantaneous dispersal of feed across the entire cross section of the riser is not possible, but good results have been obtained by injecting a highly atomized feed into a pre-accelerated stream of catalyst particles. However, the dispersing of the feed throughout the catalyst particles takes some time, so that there is some non-uniform contact between the feed and catalyst as previously described. Non-uniform contacting of the feed and the catalyst exposes portions of the feed to the catalyst for longer periods of time which can in turn produce overcracking and reduce the quality of reaction products.

It has been a long recognized objective in the FCC process to maximize the dispersal of the hydrocarbon feed into the particulate catalyst suspension. Dividing the feed into small droplets improves dispersion of the feed by increasing the interaction between the liquid and solids. Preferably, the droplet sizes become small enough to permit vaporization of the liquid before it contacts the solids. It is well known that agitation or shearing can atomize a liquid hydrocarbon feed into fine droplets which are then directed at the fluidized solid particles. A variety of methods are known for shearing such liquid streams into fine droplets.

U.S. Pat. No. 3,071,540 discloses a feed injection apparatus for a fluid catalytic cracking unit wherein a high velocity stream of gas, in this case steam, converges around the stream of oil upstream of an orifice through which the mixture of steam and oil is discharged. Initial impact of the steam with the oil stream and subsequent discharge through the orifice atomizes the liquid oil into a dispersion of fine droplets which contact a stream of coaxially flowing catalyst particles.

U.S. Pat. No. 4,434,049 shows a device for injecting a fine dispersion of oil droplets into a fluidized catalyst stream wherein the oil is first discharged through an orifice onto an impact surface located within a mixing tube. The mixing tube delivers a cross flow of steam which simultaneously contacts the liquid. The combined flow of oil and steam exits the conduit through an orifice which atomizes the feed into a dispersion of fine droplets and directs the dispersion into a stream of flowing catalyst particles.

The injection devices of the '540 and '049 patents rely on relatively high fluid velocities and pressure drops to achieve atomization of the oil into fine droplets. Providing this higher pressure drop burdens the design and increases the cost of equipment such as pumps and exchangers that are typically used to supply liquid and gas to the feed injection device. The need to replace such equipment may greatly increase the cost of retrofitting an existing liquid-solid contacting installation with such an injection apparatus.

U.S. Pat. No. 4,717,467 shows a method for injecting an FCC feed into an FCC riser from a plurality of discharge points. The discharge points in the '467 patent do not radially discharge the feed mixture into the riser.

Another useful feature for dispersing feed in FCC units is the use of a lift gas to pre-accelerate the catalyst particles before contact with the feed. Catalyst particles first enter the riser with zero velocity in the ultimate direction of catalyst flow through the riser. Initiating or changing the direction of particle flow creates turbulent conditions at the bottom of the riser. When feed is introduced into the bottom of the riser the turbulence can cause mal-distribution and variations in the contact time between the catalyst and the feed. In order to obtain a more uniform dispersion, the catalyst particles are first contacted with a lift gas to initiate upward movement of the catalyst. The lift gas creates a catalyst pre-acceleration zone that moves the catalyst along the riser before it contacts the feed. After the catalyst is moving up the riser it is contacted with the feed by injecting the feed into a downstream section of the riser. Injecting the feed into a flowing stream of catalyst avoids the turbulence and back mixing of particles and feed that occurs when the feed contacts the catalyst in the bottom of the riser. A good example of the use of lift gas in an FCC riser can be found in U.S. Pat. No. 4,479,870 issued to Hammershaimb and Lomas.

There are additional references which show use of a lift gas in non-catalytic systems. For example, in U.S. Pat. No. 4,427,538 to Bartholic, a gas which may be a light hydrocarbon is mixed with an inert solid at the bottom part of a vertical confined conduit and a heavy petroleum fraction is introduced at a point downstream so as to vary the residence time of the petroleum fraction in the conduit. Similarly, in U.S. Pat. No. 4,427,539 to Busch et al., a $C_4$ minus gas is used to accompany particles of little activity up a riser upstream of charged residual oil so as to aid in dispersing the oil.

U.S. Pat. No. 5,139,748 issued to Lomas et at. shows the use of radially directed feed injection nozzles to introduce feed into an FCC riser. The nozzles are arranged in a circumferential band about the riser and inject feed toward the center of the riser. The nozzle arrangement and geometry of the riser maintains a substantially open riser cross-section over the feed injection area and downstream riser sections.

Feed atomization, lift-gas and radial injection of feed have been used to more uniformly disperse feed over the cross-section of a riser reaction zone. Nevertheless, as feed contacts the hot catalyst, cracking and volumetric expansion of the hydrocarbons causes an increase in the volumetric rate of fluids passing up the riser. A large portion of this volumetric increase occurs immediately downstream of the feed injection point. Previous feed distributors have allowed this volumetric expansion to occur in a relatively uncontrolled fashion. The uncontrolled volumetric expansion occurring simultaneously with mixing of catalyst and hydrocarbon feed results in mat-distribution that adversely effects the quantity and quality of the products obtained from the cracking reaction. This maldistribution is caused by turbulent back mixing as well as quiescent zones in the riser section immediately downstream of the feed injection point.

SUMMARY OF THE INVENTION

It is an object of this invention to provide a method and apparatus for reducing or eliminating non-uniformity in the mixing of catalyst and feed and quiescent flow regions downstream of the feed injection to an FCC riser conduit.

It is a further objection of this invention to reduce or eliminate turbulence downstream of the feed injection point of an FCC that uses a conduit type reaction zone.

A yet further object of this invention is to increase the dispersion of a feedstream over the flowing surface area of a catalyst stream.

These objects are achieved by the use of a FCC feed distributor that mixes fresh catalyst entering a reaction conduit with a fluidizing medium to create a dense bubbling bed of catalyst and radially discharges feed hydrocarbons from a central feed distributor into a feed contact zone and passes the feed into a zone of continuously increasing cross-sectional diameter to eliminate or reduce quiescent or turbulent zones by providing an acceleration zone with a more uniform flow of catalyst and feed. The method and apparatus of this invention maintains a more uniform velocity of the catalyst and hydrocarbon mixture after the initial acceleration. A more constant velocity allows the reactants to expand into the full riser without creating the low velocity areas, i.e. quiescent areas which could result in back mixing of the catalyst and oil. In order to achieve good initial distribution the method an apparatus of this invention feeds a low velocity fluidized bed of catalyst to a feed contact zone. The feed contact zone radially discharges hydrocarbons across a feed contact zone having a narrow width and a reduced cross-sectional area relative to the rest of the riser. The feed contact zone provides good initial mixing of the catalyst and hydrocarbons. Uniform feed ejection across the contact zone is promoted by a deflector located in the feed flow path just upstream of the point where the feed contacts the catalyst. The deflector deflects an axially flowing stream of feed into a radial flow direction to provide the radial discharge of hydrocarbons. Catalyst accelerates upwardly as the flowing cross-sectional area for the feed and catalyst increases to accommodate a volumetric expansion of the feed. In this manner the invention achieves good catalyst and feed mixing without large volumes of atomizing steam or large quantities of lift-gas to preaccelerate the catalyst. These benefits are in addition to preventing the back mixing of catalyst or oil in the conduit downstream of the feed injection point.

Accordingly, in a specific embodiment, this invention is a method of mixing fluidized particles with a fluid feedstream comprising hydrocarbons. The method combines fluidized particles and a fluidizing medium in an upstream section of a conduit to produce a dense bed of catalyst. The dense bed of catalyst passes downstream along the conduit into a feed contact zone that has a reduced cross-sectional area relative to the upstream section. The feed contact zone receives a radial discharge of a fluid feed stream into the catalyst to produce a mixture of feed and catalyst. Redirecting of the fluid feedstream at the downstream end of a feed conduit by a deflector establishes the radial flow path of the feed. The mixture of feed and catalyst accelerates downstream into an acceleration zone having a continuously increasing cross-sectional area. The mixture of feed and catalyst passes from the acceleration zone into a downstream section of the conduit that has a uniform cross-sectional area.

Another embodiment of this invention is an apparatus for contacting FCC catalyst with an FCC feedstock. The apparatus includes an elongated riser conduit having an upstream and downstream end, means for adding the FCC catalyst to the upstream end of the riser conduit, and means for distributing a fluidizing medium to the upstream end of the riser to create a dense catalyst bed. A feed conduit extends up the center of the riser. A central distributor is located in the center of the riser conduit, at a location downstream of means for adding catalyst to the riser conduit. The central distributor retains an impeller at the end of the feed conduit for radially directing feed outwardly from the feed conduit and defines an extended circumferential port. The central distributor also defines an annular passage between the interior of the riser and the exterior of the distributor. The annular passage communicates with the extended circumferential pert. Means located downstream of the extended circumferential port continuously increase the cross-section of the riser conduit from that provided by the annular passage to the full cross-section of the riser conduit.

Additional objects, embodiments and details of this invention can be obtained from the following detailed description.

BRIEF DESCRIPTION OF THE DRAWINGS

FIG. 3 is shows a cross section of the feed distributor depicted in FIG. 2

FIG. 4 is a section taken across line 4—4 of FIG. 3.

DETAILED DESCRIPTION OF THE INVENTION

This invention will be described in the context of an FCC process for the catalytic cracking of hydrocarbons by contact with a fluidized catalyst.

Figure 1:
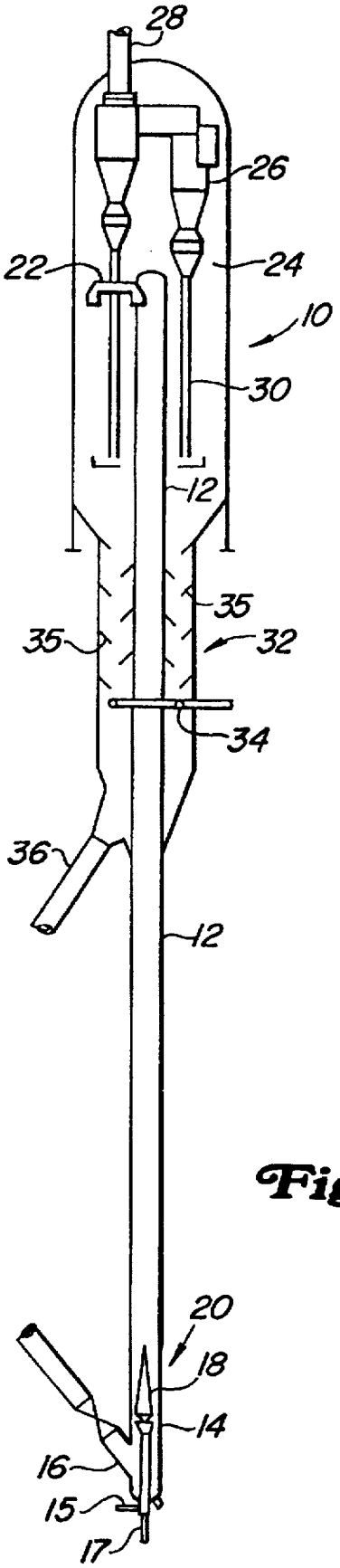
FIG. 1 is a sectional elevation of an FCC reactor and riser.

In a typical FCC process flow arrangement, freely divided regenerated catalyst leaves a regeneration zone and contacts a feedstock in a lower portion of a reactor riser zone. FIG. 1 shows a reactor 10 with a vertical riser 20 having an upper section 12 and a lower riser portion 14 into which a regenerator standpipe 16 transfers catalyst from the regenerator (not shown). Feed enters the riser through conduit 17 and a feed distributor 18. A diluent material, typically steam, also enters the bottom feed distributor 18 through a nozzle 15. While the resulting mixture, which has a temperature of from about 200° C. to about 700° C., passes up through the riser, conversion of the feed to lighter products occurs and coke is deposited on the catalyst. The effluent from the riser is discharged from the top of the riser through a disengaging arm 22 into a disengaging space 24 where additional conversion can take place. The hydrocarbon vapors, containing entrained catalyst, are then passed through one or more cyclone separators 26 to separate any spent catalyst from the hydrocarbon vapor stream.

The separated hydrocarbon vapor stream is passed from an outlet nozzle 28 into a fractionation zone (not shown) known in the art as the main column wherein the hydrocarbon effluent is separated into such typical fractions as light gases and gasoline, light cycle oil, heavy cycle oil and slurry oil. Various fractions from the main column can be recycled along with the feedstock to the reactor riser. Typically, fractions such as light gases and gasoline are further separated and processed in a gas concentration process located downstream of the main column. Some of the fractions from the main column, as well as those recovered from the gas concentration process may be recovered as final product streams.

The separated spent catalyst from cyclones 26 passes into the lower portion of the disengaging space through dip legs 30 and eventually passes out of the reaction zone passing into a stripping zone 32. A stripping gas, usually steam, enters a lower portion of zone 32 through a distributor ring 34 and contacts the spent catalyst, purging adsorbed and interstitial hydrocarbons from the catalyst. A series of baffles 35 in the stripping zone improves contact between the catalyst and stripping gas.

The spent catalyst containing coke leaves the stripping zone through a reactor conduit 36 and passes into the regeneration zone where, in the presence of fresh regeneration gas and at a temperature of from about 620° C. to about 760° C., combustion of coke produces regenerated catalyst and flue gas containing carbon monoxide, carbon dioxide, water, nitrogen and perhaps a small quantity of oxygen. Usually, the fresh regeneration gas is air, but it could be air enriched or deficient in oxygen. Flue gas is separated from entrained regenerated catalyst by cyclone separation means located within the regeneration zone and separated flue gas is passed from the regeneration zone, typically, to a carbon monoxide boiler where the chemical heat of carbon monoxide is recovered by combustion as a fuel for the production of steam, or, if carbon monoxide combustion in the regeneration zone is complete, the flue gas passes directly to sensible heat recovery means and from there to a refinery stack. Regenerated catalyst which was separated from the flue gas is returned to the lower potion of the regeneration zone which typically is maintained at a higher catalyst density. A stream of regenerated catalyst leaves the regeneration zone, and in repetition of the previously mentioned cycle, contacts the feedstock in the reaction zone.

Catalysts that can be used in this process include those known to the art as fluidized catalytic cracking catalysts. Specifically, the high activity crystalline aluminosilicate or zeolite-containing catalysts can be used and are preferred because of their higher resistance to the deactivating effects of high temperatures, exposure to steam, and exposure to metals contained in the feedstock. Zeolites are the most commonly used crystalline aluminosilicates in FCC.

Figure 2:
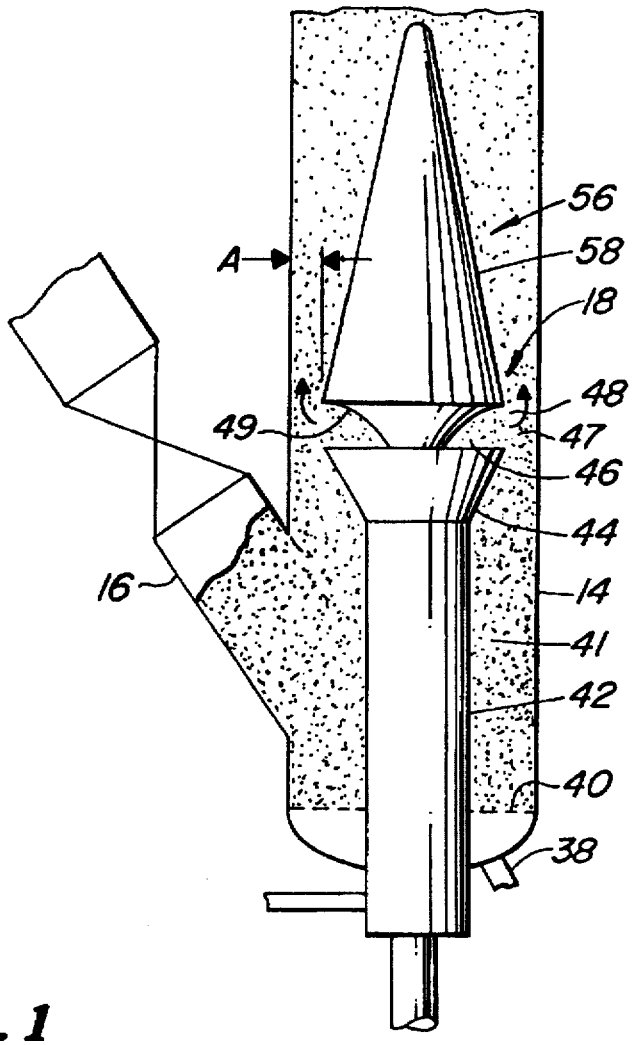
FIG. 2 is an enlarged section of the lower end of the riser shown in FIG. 1

Catalyst entering the lower section 14 of the riser conduit preferably forms a dense catalyst bed. FIG. 2 more clearly shows the detail of the bottom section 14 of the riser conduit. A fluidizing medium enters the bottom of the riser through a line 38 and contacts the catalyst entering lower section 14 through line 16 to form a dense bed 41. The term dense bed refers to a region of catalyst having a density of at least 20 pounds per cubic foot. In order to increase the uniformity of the dense bed, the fluidizing medium passes through a distribution plate 40 before contacting the catalyst. The dense bed zone is also termed a bubbling bed which provides good mixing of the catalyst and a uniform suspension of catalyst around a feed conduit 42 and a cone portion 44 of the central distributor 18. The quantity of fluidizing gas entering the bottom of the riser is usually added in an amount that creates a low upward velocity of catalyst having a velocity of less than 6 feet per second and usually in a range of from 3 to 5 feet per second.

This invention does not require a specific gas composition for the fluidizing medium. Steam can serve as a suitable fluidizing medium. The fluidizing medium can also comprise a typical lift gas and can be used by itself or in combination with steam. Lift gas typically includes not more than 10 mol % of $C_3$ and heavier hydrocarbons. In addition to hydrocarbons, other reaction species may be present in or comprise the fluidizing mediums such as $H_2$, $H_2S$, $N_2$, CO and/or $CO_2$.

Whatever type of fluidizing medium is used in the dense bed the low gas velocity through the dense bed zone requires very little fluidizing medium. Thus, in addition to the dense bed conditions providing good mixing of the catalyst and distribution of the catalyst around cone 44, it also minimizes the amount of fluidizing medium needed prior to the injection of the feed. Preferably the gas velocity through the bed is kept very low, in most cases at a rate of 2 feet per second or less. In the case of steam, the fluidizing medium will range between 0.2 and 0.5 wt %. Such low fluidizing medium rates represent a ten fold decrease over that currently used in feed distributors. Nevertheless, low gas flow is sufficient to maintain the dense bubbling bed conditions throughout the volume of catalyst located below an opening 48 of an extended circumferential port 46.

An essential element of this invention is the geometry of the catalyst flow path just ahead of the feed contact zone and the geometry of the feed and catalyst contact zone. As the catalyst passes upwardly in the dense bed, cone 44 reduces the cross-sectional area of the riser and increases the velocity of the catalyst before it contacts the feed. Cone 44 channels the catalyst into an annular passage 47 having a small width. A small diameter or small width opening is another important feature of this invention. FIG. 2 shows cone 44 channeling the catalyst into narrow annular passage 47 that provides a feed contact zone. A possible, but less effective arrangement of this invention would channel all the flow into a central orifice having a small diameter. Whether practiced with an annular feed contact zone or a central orifice, the transverse width or diameter of the feed and catalyst contact zone is carefully controlled. The width of the annular passage 47 for the feed and catalyst contact zone is shown by dimension "A" in FIG. 2. Preferably this passage will have a width of less than 8 inches and more preferably a width of less than 6 inches. The narrow transverse width of the feed catalyst contact zone insures good contact of the feed with the catalyst by allowing the feed to penetrate all or substantially all of the transverse width of the feed and catalyst contact zone. Rapid and thorough mixing between the feed and catalyst is also promoted by the use of opening 48 in the form of an extended circumferential pert 46 around the circumference of distributor 18.

The selection of width "A" is dependent upon the velocity and momentum of the feed as it exits opening 48. The pert 48 is sized to provide a fluid velocity out of opening 48 in a range of from 6 to 30 feet per second and preferably in the range of 10 to 20 ft/sec. In accordance with typical FCC practice the feed exits opening 48 as a spray. Droplet size within the spray and the velocity of the spray determines momentum of the feed as it crosses annular passage 47. It is difficult to increase the momentum of the feed above a given level since the velocity of the feed injection is inversely proportional to the size of the droplets in the emanating spray. Higher velocities for the spray tend to directly increase the momentum of the spray but indirectly decrease the momentum by reducing the size of the exiting droplets. Conversely the reduced momentum that results directly from lower spray velocities is offset by the typical production of larger droplets. Therefore minimizing the width of passage 47 offers the most effective way to increase the penetration of the feed into the flowing catalyst. A reduced width of passage 47 also permits smaller droplets to more fully contact the entire flowing volume of catalyst.

The use of the small width feed contact area and an extended circumferential port can eliminate the need for many of prior art methods of obtaining good feed distribution. The prior art methods include use of an expanding gas or gaseous component such as steam in conjunction with another source of energy in order to break up the liquid. This other source of energy can consist of a high pressure drop for the gas and liquid mixture. Supplying additional energy makes up for inadequate mixing so that a fine and uniform distribution of droplets will still be obtained once the feed is injected into the catalyst. It is also known that the pressure drop across an orifice or port can be reduced while still obtaining a good dispersion of fine liquid droplets by blending and homogenizing the liquid and any added gas sequentially in stages of increased mixing severity.

In this invention the flow path for the feed exiting the distributor 18 disperses the feed to provide a distribution of fine droplets. Before exiting opening 48 the feed undergoes a change of direction by a diverter 49. Looking then to FIG. 3 the feed tint flows axially through a feed conduit 42 in an axial direction. As the feed reaches the end of feed conduit 42 it contacts the flow diverter 49 which abruptly changes the direction of the feed thereby imparting shearing action on the particles in feed and producing the droplets that are ejected from opening 48.

The dispersion of the feed into yet finer droplets is promoted by imparting sufficient energy into the liquid. Where desired any of the prior art methods may be used in combination with the feed injection arrangement of this invention. In most cases, this invention will be practiced with some addition of a diluent such as steam to the feed before discharge through the orifices. The feed entering the feed conduit 42 will usually have a temperature below its initial boiling point but a temperature above the boiling point of any steam or gaseous hydrocarbons that enter the distribution device along with the liquid. A minimum quantity of gaseous material equal to about 0.2 wt. % of the combined liquid and gaseous mixture, is typically commingled with the liquid entering the conduit 42. The gaseous material may be injected into the conduit 42 in any manner.

As the gaseous medium and liquid, usually steam and hydrocarbons, enter the distribution device, they tend to remain segregated. Therefore, this invention may benefit from passing the mixture through a mixing device such as one or more baffles to blend the hydrocarbon and any gas into a relatively uniform hydrocarbon and gas stream. By substantially uniform, it is meant that any major segregation between the liquid and gaseous component that would tend to deliver more liquid or gaseous medium to one section or another of the circumferential port is eliminated. This blending is typically mild and normally will add a pressure drop of less than 20 psi to the system.

In a preferred form of this invention the diluent enters a distribution chamber 43 formed by a concentric inner conduit 45. The diluent enters chamber 43 via nozzle 15. Perforations 51 in the upper portion of pipe 45 inject the diluent into the flowing stream of feed as it flows through inner conduit 45. A rounded nozzle 53 at the top of inner conduit 45 provides an expansion of the mixed diluent and feed that atomizes the feed into small droplets.

Following any prior atomization the feed passes into contact with diverter 49. As mentioned previously diverter 49 may be designed to provide atomization of the feed as it exits opening 48. Diverter 49 may also impart a tangential velocity to the feed and any diluent mixed therein. FIG. 4 depicts a preferred arrangement of diverter 49. As shown by FIG. 4 the surface of diverter 49 defines a plurality of spiral vanes 55 similar in form to that of a pump impeller. As the contact the diverter the vanes give a centripetal acceleration to the feed that enhances its disbursement over the entire circumference of the opening 48. Accordingly the vanes are useful to insure a more even dispersal of the feed over the annular passage 47. In this manner the diverter 49 imparts primarily radial velocity to the exiting feed.

The preceding description explains a variety of ways in which to promote the atomization of feed to a desired degree. Therefore the size of opening 48 is not restricted by atomization requirements. The width of opening 48 may be sized to achieve the desired velocity or range of velocities for the feed as it enters annular space 47. Typically opening 48 will have a width from about ¼" to 1".

Preferably opening 48 provides a completely unobstructed flow path for the feed as it exits the feed distributor 18. However in most cases the acceleration zone of distributor 18, represented by a cone 58, will require one or more supports that structurally connects the upper portion of distributor 18 with the cone portion 44 or conduit 42. Such supports (not shown) should occupy minimum volume and to avoid interference with the distribution of the feed around the entire circumference of the feed distributor.

Following mixing and ejection, contact of the feed with the hot catalyst creates a volumetric expansion from both the vaporization of liquid hydrocarbons and heating of the vapor as well as cracking of the hydrocarbons into lower molecular weight species. Preferably this invention controls the flowing cross-sectional area of the feed and catalyst downstream of the catalyst and feed mixing zone. This control provides a gradual and continuous increase in the flowing cross-section area for the catalyst and feed mixture. Gradually increasing the flowing cross-sectional area prevents abrupt changes in the velocity of the stream and the resulting turbulence or quiescent zones that introduces variations in the feed and catalyst contact time thereby preventing uniform catalyst and feed contacting.

Referring again to FIG. 2, the zone immediately downstream of the feed and catalyst contacting is indicated by numeral 56 in FIG. 2 and termed an "acceleration zone". The term "acceleration zone" refers to the function of this zone to control the acceleration of the catalyst with the objective of providing a more constant velocity of the catalyst and feed mixture through the acceleration zone. The acceleration zone passes the catalyst and feed mixture into a section of the downstream conduit or riser having a uniform cross-section. A uniform cross-sectional area for the conduit downstream of the acceleration zone comprises at least a short section of riser wherein the cross-section area does not significantly change.

Suitable geometries for the acceleration zone will provide tapered sections that continuously increase the cross-section of the catalyst and feed mixture from the minimum diameter of the catalyst feed contact zone to the full diameter of the riser. The tapered sections should provide a smooth profile without any abrupt discontinuities that would promote turbulence or quiescent regions in the acceleration zone. Nevertheless the tapered sections may provide a linearly or non-linearly increasing flow area. However, a linearly increasing flow area is believed to most effectively to control the acceleration of the gas and catalyst stream through the acceleration zone.

The acceleration zone should have a length that will provide sufficient residence time for the expansion of gases to stabilize. A minimum residence time in the acceleration zone is about 0.05 seconds. Preferably the acceleration zone will provide a residence time for the catalyst and gas mixture of from 0.05 to 0.2 seconds. Preferably the feed and catalyst mixture will flow through the acceleration zone and into the full riser diameter approximately 0.1 to 0.15 seconds after feed injection. The acceleration zone must also be sized to accommodate substantial gas and catalyst flow velocities through the acceleration zone. As the catalyst leaves the restrictive flow area of the feed and catalyst contact zone, it is immediately accelerated to about 35 to 40 feet per second as the reaction begins. Catalyst and gas velocity through the acceleration zone will usually range from 40 to 65 feet per second. Applying these criteria to most reaction conduits, the acceleration zone will have a length of from 3 to 8 feet.

FIG. 2 depicts one form of the acceleration zone for this invention In the embodiment of FIG. 2, cone 58 defines the inner surface of the acceleration zone and the inside wall of reaction conduit 14 defines the outer surface of the acceleration zone. The cone provides a linear increase in the flowing cross-sectional area of there reaction conduit which is proportional to the distance downstream from the feed injection point. In order to provide a gradual increase in the flowing cross-sectional area the cone will have a slope of at least ¼. At the end of cone 58, the stream of catalyst and feed flows into the entire cross-section of riser 14. By the time the feed and catalyst mixture has reached the end of cone 58, the velocity of the feed is stabilized in a range of from 40 to 80 feet per second. Although additional expansion of the gases due to further cracking reactions may occur above cone 58, the majority of acceleration due to hydrocarbon heating and reaction has occurred before the feed and catalyst mixture exits the acceleration zone. Therefore, any additional increase in velocity of the feed and catalyst mixture downstream of the cone 58 will not introduce significant turbulence into the flowing mixture.

What is claimed is:

1. An apparatus for contacting FCC catalyst with an FCC feedstock, said apparatus comprising:

a) an elongated riser conduit having an upstream and a downstream end;

b) means for adding FCC catalyst to said upstream end;

c) means for distributing a fluidizing medium to said upstream end of said riser for producing a dense catalyst bed;

d) a feed conduit extending up the center of said riser;

e) a central distributor located in the center of said riser conduit at a location downstream of said means for adding catalyst to said riser conduit and at the end of said feed conduit, said central distributor retaining an impeller at the end of said feed conduit for radially directing feed outwardly from said feed conduit and defining an extended circumferential port;

f) said central distributor defining an annular feed contact zone between the interior of said riser and the exterior of said distributor, said annular feed contact zone communicating directly with said extended circumferential port; and, g) an acceleration zone located downstream of said feed contact zone defined by the interior of said riser and the exterior of said distributor including means located downstream of said circumferential port for continuously increasing the cross section of said acceleration zone to the full cross section of said riser conduit over an extended length of said riser conduit.

2. The apparatus of claim 1 wherein said means for continuously increasing the cross section of said acceleration zone comprises a cone fixed to the top of said central distributor.

3. The apparatus of claim 2 wherein said cone has a slope of at least ¼.

4. The apparatus of claim 1 wherein the annular width of said feed contact zone is not greater than 6 inches.

* * * * *